United States Patent [19]

Kunda

[11] 4,388,109

[45] * Jun. 14, 1983

[54] PROCESS FOR THE PRODUCTION OF SILVER POWDER FROM SILVER CHLORIDE, SULPHATE OR SULPHIDE

[75] Inventor: Wasyl Kunda, Edmonton, Canada

[73] Assignee: Sherritt Gordon Mines Limited, Toronto, Canada

[ * ] Notice: The portion of the term of this patent subsequent to Dec. 22, 1998, has been disclaimed.

[21] Appl. No.: 264,724

[22] Filed: May 18, 1981

Related U.S. Application Data

[63] Continuation-in-part of Ser. No. 179,603, Aug. 9, 1980, Pat. No. 4,306,902.

[51] Int. Cl.[3] ..... B22F 9/00; C22B 11/00

[52] U.S. Cl. ..... 75/0.5 B; 75/83; 423/499; 423/551

[58] Field of Search ..... 75/0.5 B, 83; 423/499, 423/551

[56] References Cited

U.S. PATENT DOCUMENTS 3,929,466 12/1975 Moynahan et al. ..... 75/83

4,306,902 12/1981 Kunda ..... 75/0.5 B

*Primary Examiner*—M. J. Andrews

*Attorney, Agent, or Firm*—Robert F. Delbridge; Arne I. Fors

[57] ABSTRACT

A process for the production of elemental silver from silver chloride, silver sulphate or silver sulphide includes mixing the silver salt with sodium carbonate, and heating the mixture at a temperature in the range of from about 500° C. to about 650° C. to produce a product mixture comprising elemental silver powder and a product sodium salt selected from the group consisting of sodium chloride and sodium sulphate. The product mixture is then cooled, and the product sodium salt and any unreacted sodium carbonate removal from the elemental silver powder by washing with water.

7 Claims, No Drawings

PROCESS FOR THE PRODUCTION OF SILVER POWDER FROM SILVER CHLORIDE, SULPHATE OR SULPHIDE

This is a continuation-in-part of U.S. application Ser. No. 179,603, filed Aug. 9, 1980, now U.S. Pat. No. 4,306,902.

This invention relates to the production of elemental silver from silver chloride, silver sulphate or silver sulphide.

In the hydrometallurgical treatment of silver-containing materials, silver chloride or silver sulphate are frequently produced. Known methods for the production of elemental silver from these salts have various disadvantages. One known method is to heat silver chloride with metallic zinc powder, but metallic zinc powder is expensive and the silver product is unduly contaminated with zinc. Further, a temperature of about 1100° C. is required for this reaction, and at this temperature the reduced metallic silver tends to react with a ceramic or metallic reaction vessel, thereby further contaminating the silver.

It has also been proposed to reduce an aqueous suspension of silver chloride in the presence of metallic zinc powder or silver ammine sulphate solution with hydrogen gas. However, the hydrogen reagent is also relatively expensive and the reaction has to be carried out under pressure in an autoclave.

It is therefore an object of the invention to provide an improved process for the recovery of elemental silver from silver chloride or silver sulphate.

The present invention is based on the discovery that elemental silver in the form of fine powder can be produced by mixing silver chloride or silver sulphate with sodium carbonate, and heating the mixture at a temperature in the range of from about 500° C. to about 650° C. to effect a solid stage reaction. The reaction is usually complete relatively quickly, for example in about one hour, and the silver powder produced does not significantly react with a ceramic or suitable metallic reaction vessel. Sodium chloride or sodium sulphate is also produced in the reaction and, together with any unreacted sodium carbonate, may readily be removed by washing with water. The other reaction products are carbon dioxide and oxygen which are of course harmless gases. The silver product is usually directly obtained as a fine powder. Some slight sintering may occur at a temperature above about 625° C., but this can readily be broken up.

It has also been found that elemental silver in the form of fine powder can be produced by mixing silver sulphide with sodium carbonate, and heating the mixture at a temperature in the range of from about 500° C. to about 650° C. to effect a solid state reaction. Sodium sulphate is also produced in the reaction and, together with any unreacted sodium carbonate, may be readily removed by washing with water. The other primary reaction product is carbon dioxide which is of course harmless. Some sodium dioxide may also be produced, but it has been found that this may be minimized by using sufficient sodium carbonate such that sodium sulphate is formed. In other words, there should be a slight stoichiometric excess of sodium carbonate.

In the case of silver chloride, the mixture is preferably heated at a temperature over about 570° C. to ensure completeness of the reaction and below about 625° C. to lessen the likelihood of sintering. In the case of silver sulphate, the reaction does take place substantially at a lower temperature than in the case of silver chloride, and thus the temperature range of from about 500° C. to about 550° C. is preferred in the case of silver sulphate.

Stoichiometrically, it would have been expected that about one-half mole of sodium carbonate would have been required for each mole of silver chloride, in accordance with the following reaction:

$$2AgCl + Na_2CO_3 \rightarrow 2Ag + 2NaCl + CO_2 + \tfrac{1}{2}O_2$$

However, it has been found that about one mole of sodium carbonate, i.e. 100% stoichiometric excess, per mole of silver chloride should be provided to ensure completeness of reaction.

In the case of silver sulphate, it would have been expected that about one mole of sodium carbonate would be required for each mole of silver sulphate in accordance with the following reaction:

$$Ag_2SO_4 + Na_2CO_3 \rightarrow 2Ag + Na_2SO_4 + CO_2 + \tfrac{1}{2}O_2$$

Again it has been found that about 100% excess of sodium carbonate should be provided to ensure completeness of reaction, that is to say there should be about two moles of sodium carbonate per mole of silver sulphate.

The silver chloride or sulphate and the sodium carbonate can be mixed in any manner which produced a thorough mixture, and the heating may be carried out in an ordinary atmosphere in a ceramic or suitable metallic reaction vessel.

In the case of silver sulphide, an advantage of this aspect of the invention is that, in practice, the silver sulphide is likely to be contaminated with free sulphur, and at the temperature of the reaction the free sulphur is oxidized to sulphur dioxide which, as mentioned earlier, is converted to sodium sulphate if a sufficient amount of sodium carbonate is used. In this case, the reaction is preferably carried out at a temperature of at least about 600° C. The reaction will usually be substantially complete in about 3 hours.

This aspect of the invention is especially useful in the recovery of silver as elemental silver powder from spent photographic solutions, for example fixing solution or bleach solution. Such solutions may be treated with hydrogen sulphide gas to produce a precipitate comprising silver sulphide and sulphur. After separation of the precipitate, the precipitate may then be treated with sodium carbonate in accordance with the invention.

Specific examples of the invention will now be described.

EXAMPLE 1

Quantities of silver chloride and sodium carbonate to give a 1:1 molar ratio were mixed in an electric blender, then placed in a porcelain boat, and the boat was heated to about 600° C. in a furnace under an air atmosphere. After one hour, the furnace was cooled to 100° C., and the product was pulverized to break down some minor sintering and then washed with water.

The silver powder product had an apparent density of 1.5 g/cc and a Fisher number of 11.6. Chemical analysis of the silver powder revealed the presence of less than 0.01% oxygen, 0.002% carbon, 0.0012% sulphur and 0.12% chlorine.

EXAMPLE 2

The test of Example 1 was repeated with silver sulphate instead of silver chloride, with the molar ratio of silver chloride to sodium carbonate being 1:2 and the furnace being heated only to 510° C. The silver powder product had similar properties to the product in Example 1.

EXAMPLE 3

Silver sulphide precipitate produced by treatment of a spent photographic solution with hydrogen sulphide gas contained about 3% by weight free sulphur. 5 grams of this precipitate was mixed with 2.5 grams of sodium carbonate, and heated in a porcelain boat to about 650° C. in a furnace under an air atmosphere. After 3 hours, the furnace was cooled, and the product pulverized to break up some minor sintering and then washed with water. The silver powder product had an apparent density of 1.97 g/cc and contained only 0.008% sulphur.

It will therefore be seen that the present invention provides a relatively pure silver powder in an inexpensive manner.

Other examples of the invention will be apparent to a person skilled in the art, the scope of the invention being defined in the appended claims.

What I claim as new and desire to protect by Letters Patent of the United States is:

1. A process for the production of elemental silver from a silver salt selected from the group consisting of silver chloride, silver sulphate and silver sulphide, said process comprising mixing the silver salt with sodium carbonate, and heating the mixture at a temperature in the range of from about 500° C. to about 650° C. to produce a product mixture comprising elemental silver powder and a product sodium salt selected from the group consisting of sodium chloride and sodium sulphate, cooling the product mixture, and removing the product sodium salt and any unreacted sodium carbonate from the elemental silver powder by washing with water.

2. A process according to claim 1 wherein the silver salt is silver chloride, and the mixture is heated at a temperature in the range of from about 570° C. to about 625° C. to produce elemental silver powder.

3. A process according to claim 1 wherein the silver salt is silver chloride, and the silver chloride and sodium carbonate are mixed in the proportion of about 1 mole of sodium carbonate per mole of silver chloride.

4. A process according to claim 1 wherein the silver salt is silver sulphate, and the mixture is heated at a temperature in the range of from about 500° C. to about 550° C. to produce elemental silver powder.

5. A process according to claim 1 wherein the silver salt is silver sulphate, and the silver sulphate and sodium carbonate are mixed in the proportions of about two moles of sodium carbonate per mole of silver sulphate.

6. A process according to claim 1 wherein the silver salt is silver sulphide.

7. A process according to claim 6 in which the mixture is heated at a temperature of at least about 600° C.

* * * * *